US006918271B2

(12) United States Patent
Lim et al.

(10) Patent No.: US 6,918,271 B2
(45) Date of Patent: Jul. 19, 2005

(54) INNER TUB FOR WASHING MACHINE

(75) Inventors: Hee-Tae Lim, Incheon (KR); Jae-Won Chang, Gunpo (KR); Seung-Chul Park, Gwangmyeong (KR); Gwan-Ryong Park, Seoul (KR)

(73) Assignee: LG Electronics Inc., Seoul (KR)

( * ) Notice: Subject to any disclaimer, the term of this patent is extended or adjusted under 35 U.S.C. 154(b) by 370 days.

(21) Appl. No.: 10/207,203

(22) Filed: Jul. 30, 2002

(65) Prior Publication Data

US 2003/0131637 A1 Jul. 17, 2003

(30) Foreign Application Priority Data

Jan. 17, 2002 (KR) ..... 2002-2806

(51) Int. Cl.[7] ..... D06F 37/12
(52) U.S. Cl. ..... 68/23.2; 68/142; 68/132
(58) Field of Search ..... 68/23.3, 132, 24, 68/58, 25, 140, 142; D32/8, 11, 29

(56) References Cited

U.S. PATENT DOCUMENTS 1,590,470 A * 6/1926 Means ..... 134/187
2,498,420 A * 2/1950 Hemmeter ..... 68/23.2
2,563,046 A * 8/1951 Killin ..... 68/23 R
2,684,585 A * 7/1954 Smith ..... 68/133
3,145,551 A * 8/1964 Ziegler ..... 68/4
3,195,327 A * 7/1965 Cobb ..... 68/12.01
3,626,728 A * 12/1971 Traube et al. ..... 68/18 F
4,848,105 A * 7/1989 O'Connell et al. ..... 68/18 F
5,373,715 A * 12/1994 Sharp et al. ..... 68/23 R
5,701,767 A * 12/1997 Cho ..... 68/134
6,279,357 B1 * 8/2001 Didlick et al. ..... 68/20
2003/0167808 A1 * 9/2003 Ugalde Blanco ..... 70/257

FOREIGN PATENT DOCUMENTS

GB 2179963 * 3/1987
JP 4-348796 * 12/1992

* cited by examiner

*Primary Examiner*—Frankie L. Stinson
(74) *Attorney, Agent, or Firm*—Birch, Stewart, Kolasch & Birch, LLP

(57) ABSTRACT

An inner tub for a washing machine, which is able to increase a dried degree of laundries and to increase a reliability of the washing machine by improving a structure of an inner tub hub and reinforcing the inner tub to make a spin-drying of high speed possible, comprises an inner tub body; an inner tub base formed on a lower part of the inner tub body; and an inner tub hub coupled on a lower surface of the inner tub base, including a rotating shaft coupling portion to which a rotating shaft for transmitting a rotating force of a driving motor is coupled, a radial supporting portion extended in an outer boundary direction of the rotating shaft coupling portion with a predetermined gap therebetween, and a ring type supporting portion having a predetermined width in an outer circumferential direction of the radial supporting portion formed integrally.

24 Claims, 6 Drawing Sheets

INNER TUB FOR WASHING MACHINE

BACKGROUND OF THE INVENTION

1. Field of the Invention

The present invention relates to an inner tub for a washing machine, and particularly, to an inner tub for a washing machine by which a spin-drying of high speed can be made.

2. Description of the Background Art

Generally, washing machines can be divided into clutch driving type and direct drive type. Herein, the clutch driving type is a method for transmitting a driving force generated from a motor to a pulsator using a belt, pulley, and clutch, and the direct drive type is a method for driving a washing machine directly by connecting the driving motor to the washing motor.

FIG. 1 is a cross-sectional view showing a direct drive type washing machine according to the conventional art.

The conventional direct drive type washing machine comprises: a case 102 with an opened upper part; an outer tub 104, in which wash water is filled, supported inside the case 102; an inner tub 106 installed in the outer tub 104 so as to be rotatable for washing laundries; and a driving motor 110 installed on lower side of the outer tub 104 for rotating the inner tub 106 through a rotating shaft 108.

As shown FIGS. 1 and 2, the inner tub 106 comprises: an inner tub body 112 of cylindrical shape having a predetermined space in which the laundries are filled; an inner tub base 114 formed to make a bottom surface of the inner tub body 112 and having a pulsator 120 formed integrally or connected rotatably therein for making a wash water flow; and an inner tub hub 116 mounted on an outer surface of the inner tub base 114 for coupling the rotating shaft 108.

Herein, as shown in FIG. 3, a wash water circulating hole 122 through which the wash water passes is formed on a center of the outer surface of the inner tub base 114, and a groove 124 is formed so that the pulsator 120 is formed in radial direction centering around the wash water circulating hole 122.

As shown in FIG. 4, the inner tub hub 116 is formed as a triangle coupled to the outer surface of the inner tub base 114, a rotating shaft coupling hole 126 to which the rotating shaft 108 is coupled is formed on a center of the inner tub hub, and a plurality of supporting ribs 128 are formed as a radial shape centering around the rotating shaft coupling hole 126 in a circumferential direction. in addition, a plurality of bolt coupling holes 130 are formed on the outer side of the inner tub hub 116 for coupling to the inner tub base 114 using bolts.

In addition, in the conventional washing machine described above, the inner tub hub is formed as a triangle to couple the rotating shaft, however, the inner tub hub is not able to support the inner tub 106. Therefore, the rotation at high speed of the inner tub can not be made, and the spin-drying speed can not be increased. Thereby the spin-drying efficiency is lowered, and the dried degree of the laundries is also lowered.

That is, in order to increase the dried degree of the laundries, the spin-drying speed should be increased. However, in case of increasing the spin-drying speed, the centrifugal force is increased and stress applied to the inner tub is also increased, and thereby, reliability of the washing machine is lowered and vibration and noise are caused. Especially, it is difficult to increase the spin-drying speed more than a certain degree in a large capacity washing machine.

SUMMARY OF THE INVENTION

Therefore, an object of the present invention is to provide an inner tub for a washing machine which is able to increase dried degree of laundries and reliability of the washing machine by improving a structure of an inner tub hub to reinforce the inner tub.

To achieve the object of the present invention, as embodied and broadly described herein, there is provided an inner tub for a washing machine comprises: an inner tub body in which laundries are received; an inner tub base formed on a lower part of the inner tub body and including a drainage hole through which wash water passes; and an inner tub hub coupled on a lower surface of the inner tub base, including a rotating shaft coupling portion to which a rotating shaft for transmitting a rotating force of a driving motor is coupled, a radial supporting portion extended in an outer boundary direction of the rotating shaft coupling portion with a predetermined gap therebetween, and a ring type supporting portion having a predetermined width in an outer circumferential direction of the radial supporting portion formed integrally.

The rotating shaft coupling portion of the inner tub includes a rotating shaft coupling hole, to which the rotating shaft for transmitting the rotating force of the driving motor to the inner tub is coupled, penetrated on a center thereof, a plurality of circular ribs formed with a predetermined interval therebetween from the rotating shaft coupling hole to outer side; and a plurality of linear ribs formed in a radial direction centering around the rotating shaft coupling hole.

A plurality of drainage holes communicated to the drainage opening of the inner tub base to discharge the wash water therethrough are formed between the circular rib of the rotating shaft coupling portion on the inner tub and adjacent circular rib.

The radial supporting portion of the inner tub is formed as a plate formed between the outer circumferential surface of the rotating shaft coupling portion and the ring type supporting portion in the circumferential direction with a predetermined interval. And supporting ribs are protruded on an upper surface of the radial supporting portion.

Some parts of the radial supporting portion of the inner tub connected to the rotating shaft coupling portion and the ring type supporting portion are shaped as a curved surface in order to prevent stress from concentrating on that parts.

The radial supporting portions of the inner tub is formed to be at least 4 or more between the rotating shaft coupling portion and the ring type supporting portion.

The ring type supporting portion of the inner tub is formed as a round plate having a predetermined width on an end part of the radial supporting portion, and a plurality of bolt holes for coupling to the inner tub base using bolts are formed in the circumferential direction of the ring type supporting portion with predetermined gaps therebetween.

On an inner circumferential surface edge and on the outer circumferential surface edge of the ring type supporting portion, the supporting ribs are protruded as predetermined widths.

The inner tub hub of the inner tub is formed as a round plate on which a rotating shaft coupling hole is formed, includes a plurality of supporting ribs having a predetermined shapes protruded on the inner tub hub, and includes a plurality of bolt coupling holes for coupling to the inner tub base using bolts formed in the outer circumferential direction of the inner tub hub.

There is provided an inner tub comprising: an inner tub body in which laundries are received; an inner tub base formed on a lower part of the inner tub body; and an inner tub hub, to which a rotating shaft of a driving motor is coupled, coupled to a lower surface of the inner tub base, wherein the inner tub base comprises a wash water circulating hole, through which the wash water in the inner tub is discharged, formed on a center thereof, and convex portions protruded toward the circumferential direction of the wash water circulating hole formed with a certain interval.

In addition, a bolt coupling hole for coupling with the inner tub hub using bolt is formed on an upper surface of the convex portion of the inner tub base.

And grooves are formed on edge of the inner tub base in the circumferential direction with a predetermined gaps therebetween.

There is also provided an inner tub comprising: an inner tub body in which laundries are received; an inner tub base formed on a lower part of the inner tub body and including a wash water circulating hole through which the wash water in the inner tub is circulated formed on a center thereof, and convex portions protruded as a predetermined widths in the circumferential direction of the wash water circulating hole; and an inner tub hub coupled on lower part of the inner tub base, and including a rotating shaft coupling portion to which the rotating shaft is coupled formed on a center thereof, a radial supporting portion extended toward the outer circumferential direction of the rotating shaft coupling portion with a predetermined interval, and a ring type supporting portion having a predetermined width toward the outer circumferential direction of the radial supporting portion.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may be a plurality of embodiments for the inner tub in the washing machine according to the present invention, however, the most preferred embodiment will be described as follows.

Figure 1:
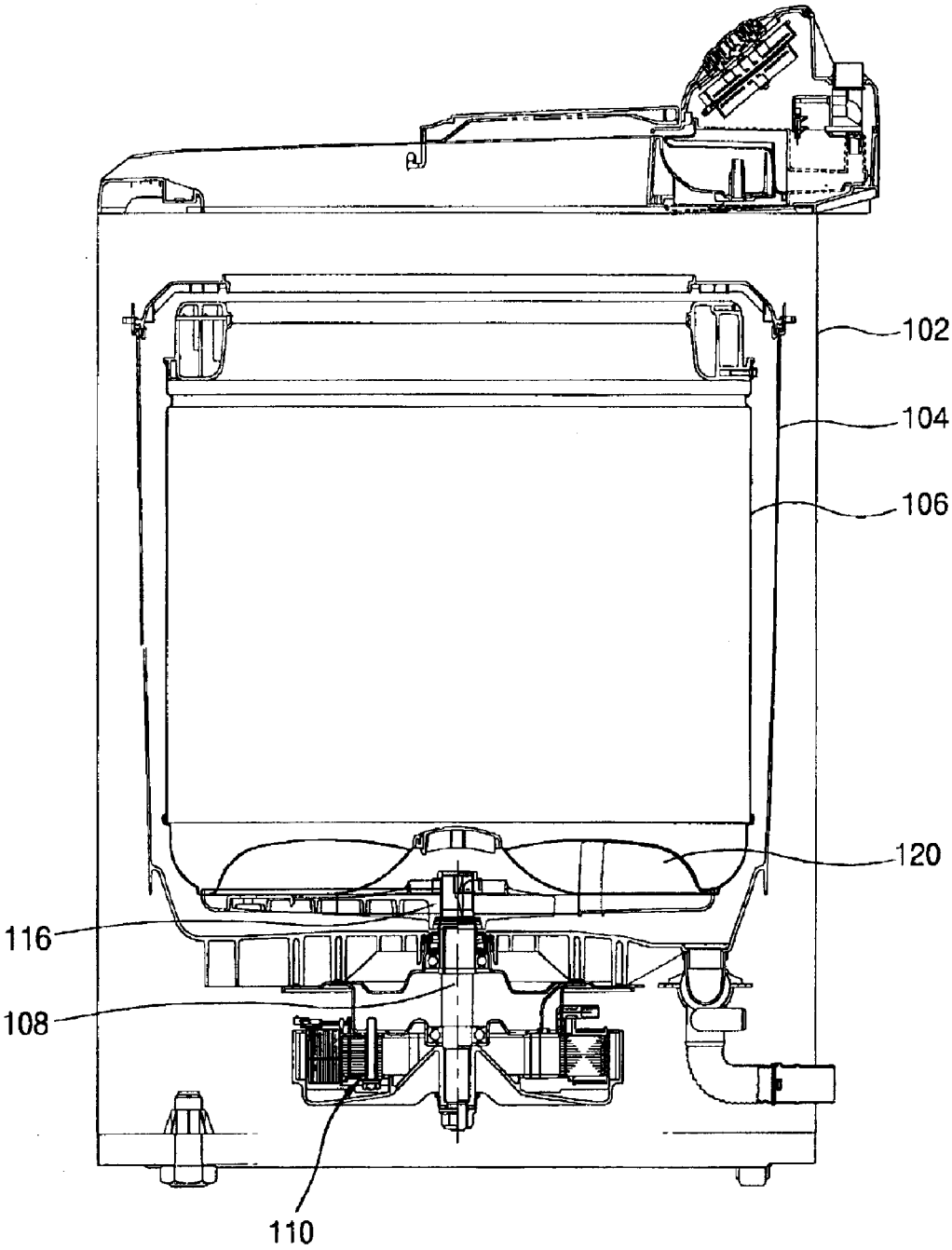
FIG.1 CONVENTIONAL ART
FIG. 1 is a longitudinal cross-sectional view showing a washing machine according to the conventional art.
Figure 2:
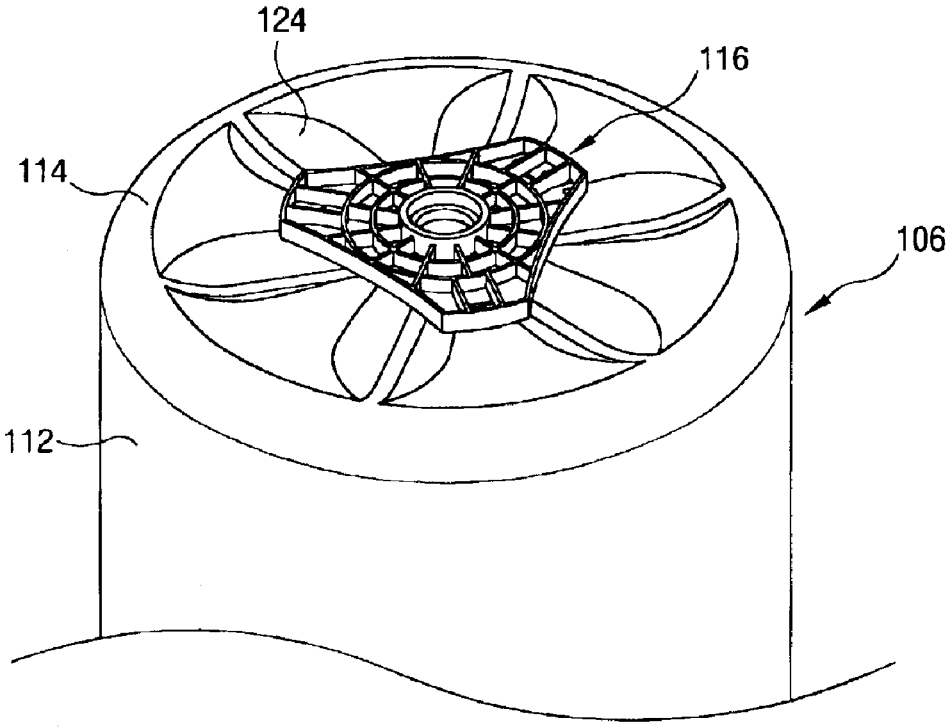
FIG.2 CONVENTIONAL ART
FIG. 2 is a perspective view showing the washing machine according to the conventional art viewing from a rear of an inner tub in the washing machine.
Figure 3:
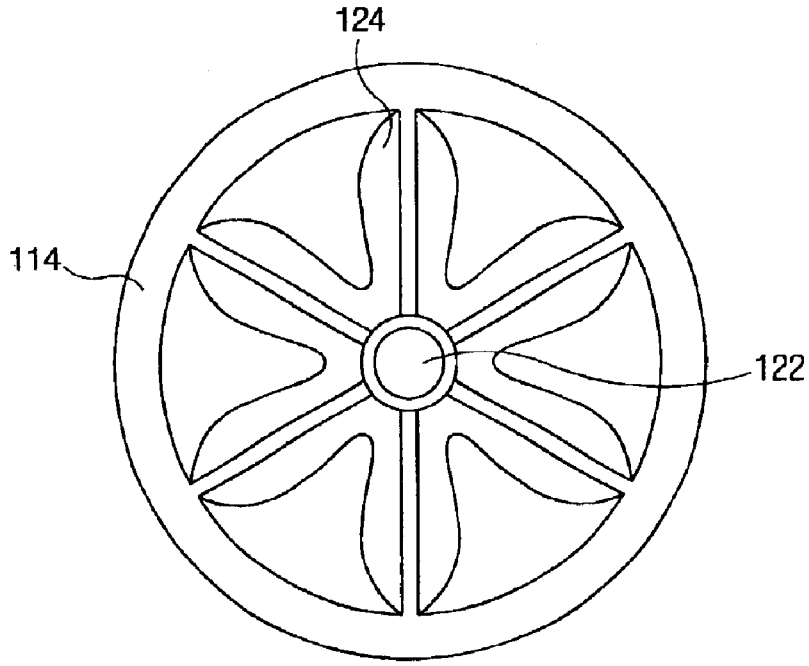
FIG.3 CONVENTIONAL ART
FIG. 3 is a front view showing an inner tub base in the washing machine according to the conventional art.
Figure 4:
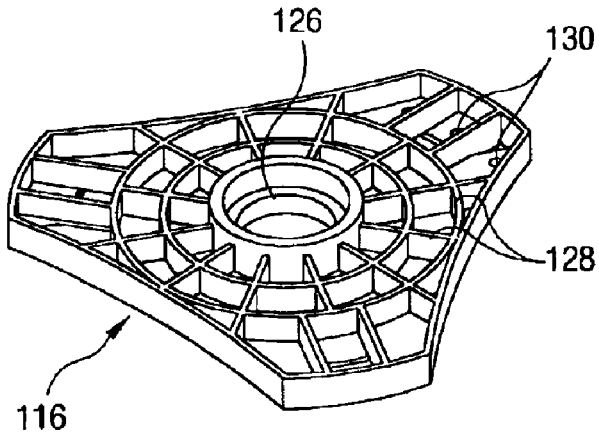
FIG.4 CONVENTIONAL ART
FIG. 4 is a perspective view showing an inner tub hub in the washing machine according to the conventional art.
Figure 5:
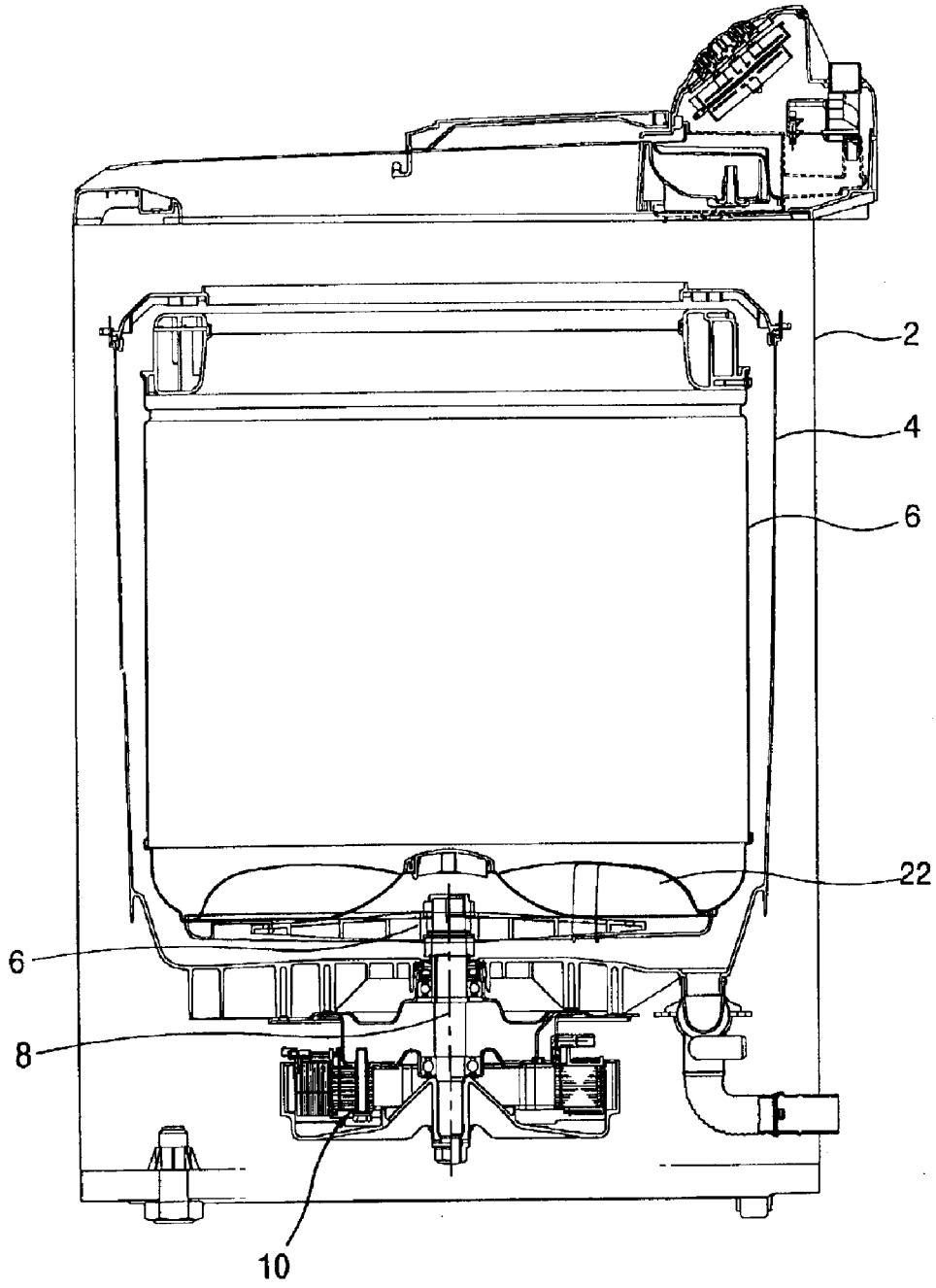
FIG. 5 is a cross-sectional view showing a washing machine according to the present invention.
Figure 6:
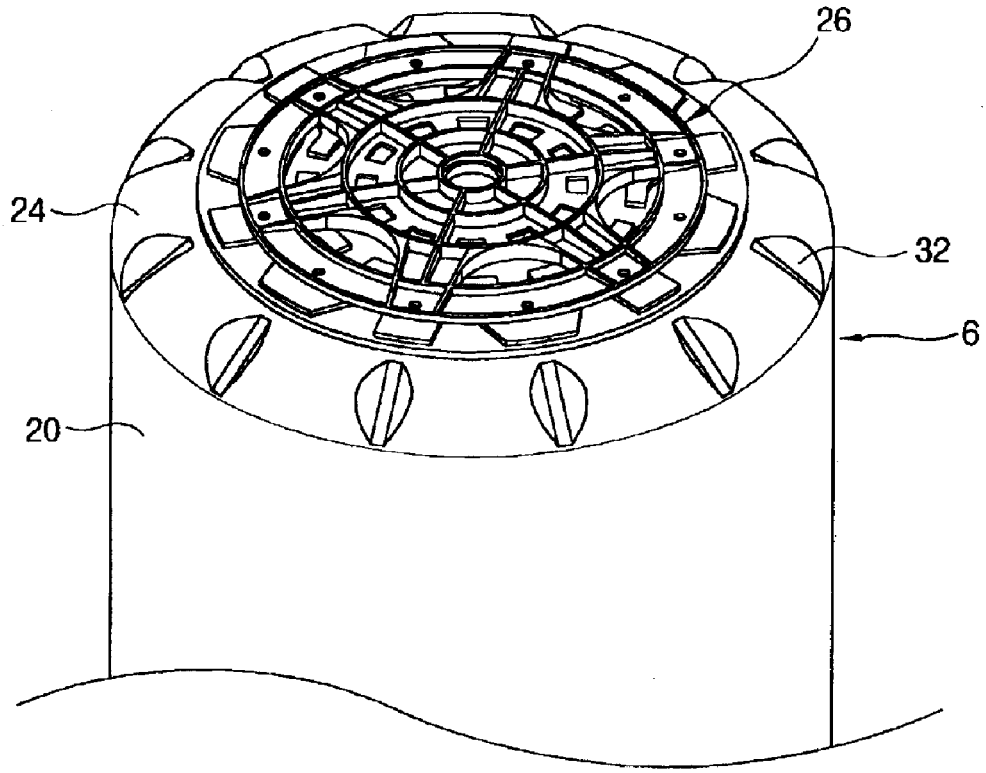
FIG. 6 is a perspective view showing an inner tub in the washing machine according to the present invention viewing from a rear part.

FIG. 5 is a partial cross-sectional view showing the washing machine according to the present invention, and FIG. 6 is a perspective view showing an inner tub in the washing machine according to the present invention viewing from a rear part.

As shown in FIG. 5, the washing machine according to an embodiment of the present invention comprises: a case 2 with an opened upper part; an outer tub 4 supported inside the case 2 for storing wash water; an inner tub 6 installed in the outer tub to be rotatable for washing laundries; and a driving motor 10 installed on a lower part of the outer tub 4 and connected to the inner tub using a rotating shaft 8 for generating a driving force rotating the inner tub 6.

As shown in FIG. 6, the inner tub 6 comprises: an inner tub body 20 of cylindrical shape for storing the laundries; an inner tub base 24 mounted on a bottom surface of the inner tub body 20 and including a pulsator 22 formed integrally or connected rotatably therein for making a wash water flow; and an inner tub hub 26, to which the rotating shaft 8 is coupled, coupled to an outer surface of the inner tub base 24 for supporting the inner tub.

Figure 7:
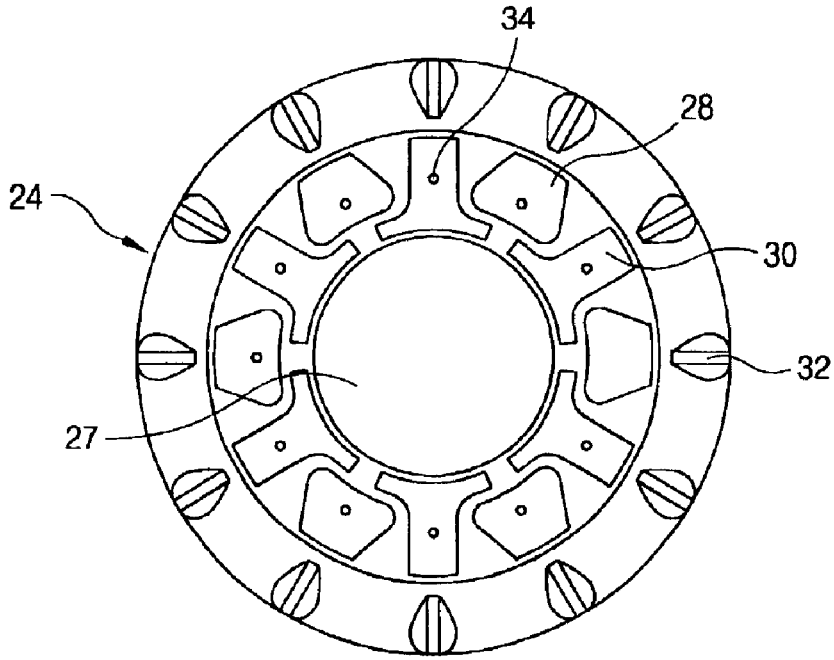
FIG. 7 is a front view showing an inner tub base in the washing machine according to the present invention.

As shown in FIG. 7, the inner tub base 24 is a round shape formed on a lower part of the inner tub body 20. And the wash water circulating hole 27, through which the wash water in the inner tub passes, is formed on the center of the inner tub base 24. In addition convex portions 28 and 30 having predetermined shapes are protruded with a predetermined intervals in the circumferential direction of the wash water circulating hole 27, and a groove 32 is formed on an edge of the inner tub base 24 in the circumferential direction with a predetermined interval.

The convex portions 28 and 30 are formed in a circumferential direction between the wash water circulating hole 27 and the groove 32 as various shapes in turns. In addition, the protruded upper part is formed as a plate and a bolt hole 34 coupled to the inner tub hub 26 is formed thereon.

Figure 8:
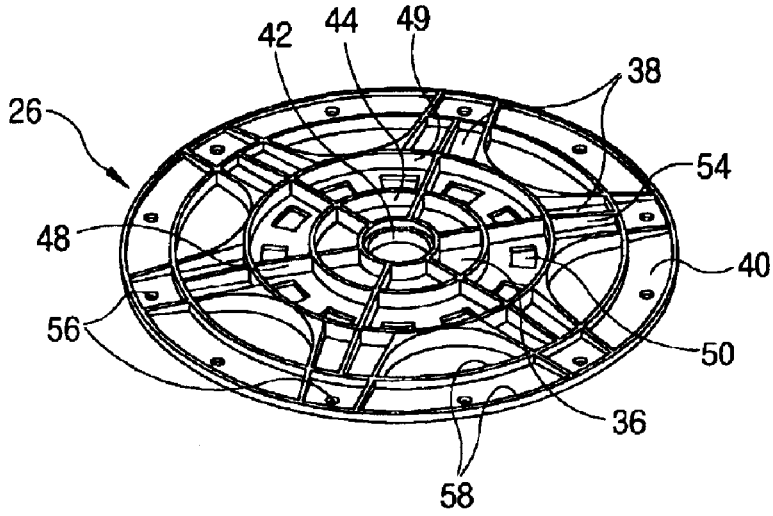
FIG. 8 is a perspective view showing an inner tub hub in the washing machine according to the present invention.

As shown in FIG. 8, the inner tub hub 26 is formed as a round plate, includes a rotating shaft coupling portion 36 to which the rotating shaft is coupled is formed on a center thereof, a radial supporting portion 38 extended in the outer circumferential direction of the rotating shaft coupling portion 36 with a predetermined gap, and a ring type supporting portion 40 having a predetermined width formed integrally in the outer circumferential direction of the radial supporting portion 38.

The rotating shaft coupling portion 36 comprises a rotating shaft coupling hole 42 to which the rotating shaft 8 is coupled penetrated on the center part thereof. A first circular rib 44 and a second circular rib 46 are protruded apart a predetermined interval from the rotating shaft coupling hole 42 toward outside. And a plurality of linear ribs 48 are protruded in a radial direction centering around the rotating shaft coupling hole 42. In addition, a plurality of drainage holes 50 connected to the wash water circulating hole 26 of the inner tub base 24 so that the wash water passes are formed between the first circular rib 44 and the second circular rib 46.

The radial supporting portion 38 is formed as a plate which is extended from the outer side surface of the second circular rib 46 with a predetermined interval to be connected to the inner circumferential surface of the ring type supporting portion 40, and a supporting rib 54 is protruded on an upper surface thereof. In addition, the parts of the radial supporting portion 38, which are connected to the rotating shaft coupling portion 42 and the ring type supporting portion 40, are formed as curved surfaces to prevent the stress generated around the connected parts from being concentrated.

The ring type supporting portion 40 is formed as a round plate having a predetermined width on the end part of the radial supporting portion 38, and comprises a plurality of bolt holes 56, which are communicated with the bole holes 34 formed on the inner tub base 24 to be coupled, formed in the circumferential direction of the ring type supporting portion 40 with predetermined intervals. In addition, supporting ribs 58 are protruded as a predetermine width on an inner edge and on an outer edge of the ring type supporting portion 40.

Operations of the washing machine will be described as follows.

When the driving motor 10 is operated, the rotating shaft 8 is rotated. And the rotating force of the rotating shaft 8 is transmitted to the inner tub 6 or pulsator 22. Then the washing water flow is making by the pulsator 22 to perform the washing operation of laundries.

In addition, when the washing operation of the laundries are completed, spin-drying stroke is operated.

That is, the spin-drying stroke is made by centrifugal force as the inner tub 6 is rotated at high speed. At that time, as the spinning speed of the inner tub 6 is increased, the dried degree of the laundries is also increased. However, as the spinning speed of the inner tub 6 is increased, the centrifugal force of the inner tub 6 is increased and vibration and noise are increased. And when the spinning speed of the inner tub 6 is increased, some of principal reasons affecting to displacement and stress of the inner tub 6 are the shape of the inner tub base 24 and the structure of the inner tub hub 26.

Therefore, when the inner tub base 24 and the inner tub hub 26 described above are applied in the washing machine, the displacement and the stress can be reduced greatly in case of increasing the spinning speed of the inner tub 6 as shown in following table.

TABLE 1

| Model | rpm | Displacement (mm) | Stress (Mpa) | First mode (Hz) |
|---|---|---|---|---|
| Conventional | 710 | 1.0 | 100 | 50 |
| art | 1,000 | 1.98 | 198 | 50 |
| Present invention | 1,000 | 1.48 | 24.9 | 54 |

As shown in Table 1, in case that rpm of the driving motor 10 is increased from 710 rpm to 1000 rpm to increase the spinning speed of the inner tub 6, the displacement of the inner tub 6 is greatly increased from 1.0 mm to 1.98 mm in the conventional art, however, the displacement of the inner tub 6 according to the present invention is increased a little, from 1.0 mm to 1.48 mm, and thereby an interruption between the inner tub 6 and the outer tub 4 may not be generated.

In addition, when the rpm of the driving motor 10 is increased as described above, the stress on the inner tub of the conventional art is increased from 100 Mpa to 198 Mpa, however, the stress on the inner tub 6 of the present invention is reduced from 100 Mpa to 24.9 Mpa instead of increasing.

Effects of the washing machine according to the present invention will be described as follows.

In the present invention, the convex portion is formed on the inner tub base in the circumferential direction with a predetermined interval, and the rotating shaft coupling portion to which the rotating shaft is coupled is formed on the center of the inner tub hub. In addition, the radial supporting portion is extended in the outer circumferential direction of the rotating shaft coupling portion, and the ring type supporting portion having a predetermined width is formed integrally on the outer circumferential direction of the radial supporting portion. Thereby, the displacement of the inner tub and stress concentrating generated when the spinning speed is increased can be greatly reduced to make the spin-drying of high speed possible, and accordingly, the dried degree of the laundries can be increased and the energy efficiency of the washing machine can be increased.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An inner tub for a washing machine comprising:

an inner tub body in which laundry is received;

an inner tub base formed on a lower part of the inner tub body and including a drainage hole through which wash water passes; and an inner tub hub coupled on a lower surface of the inner tub base, including a rotating shaft coupling portion to which a rotating shaft for transmitting a rotating force of a driving motor is coupled, a radial supporting portion extended in an outer boundary direction of the rotating shaft coupling portion with a predetermined gap therebetween, and a ring type supporting portion having a predetermined width in an outer circumferential direction of the radial supporting portion formed integrally, the radial supporting portion of the inner tub being formed as a plate between the outer circumferential surface of the rotating shaft coupling portion and the ring type supporting portion in the circumferential direction with a predetermined interval.

2. The inner tub of claim 1, wherein the rotating shaft coupling portion includes a rotating shaft coupling hole, to which the rotating shaft for transmitting the rotating force of the driving motor to the inner tub is coupled, penetrated on a center thereof, a plurality of circular ribs formed with a predetermined interval therebetween from the rotating shaft coupling hole to outer side, and a plurality of linear ribs formed in a radial direction centering around the rotating shaft coupling hole.

3. The inner tub of claim 2, wherein a plurality of water wash circulating holes communicated to the drainage opening of the inner tub base to discharge the wash water therethrough are formed between the circular rib of the rotating shaft coupling portion on the inner tub and an adjacent circular rib.

4. The inner tub of claim 1, wherein a supporting rib is protruded on an upper surface of the radial supporting portion.

5. The inner tub of claim 4, wherein parts of the radial supporting portion, which are connected to the rotating shaft coupling portion and the ring type supporting portion, are shaped as curved surfaces in order to prevent stress from concentrating on that parts.

6. The inner tub of claim 5, wherein 6 radial supporting portions are formed between the rotating shaft coupling portion and the ring type supporting portion.

7. The inner tub of claim 1, wherein the inner tub hub of the inner tub is formed as a round plate on which a rotating shaft coupling hole is formed, the inner tub hub includes a plurality of supporting ribs having a predetermined shapes protruded on the inner tub hub, and includes a plurality of bolt coupling holes for coupling to the inner tub base using bolts formed in the outer circumferential direction of the inner tub hub.

8. An inner tub for a washing machine comprising:

an inner tub body in which laundry is received;

an inner tub base formed on a lower part of the inner tub body and including a drainage hole through which wash water passes; and an inner tub hub coupled on a lower surface of the inner tub base, including a rotating shaft coupling portion to which a rotating shaft for transmitting a rotating force of a driving motor is coupled, a radial supporting portion extended in an outer boundary direction of the rotating shaft coupling portion with a predetermined gap therebetween, and a ring type supporting portion having a predetermined width in an outer circumferential direction of the radial supporting portion formed integrally, the ring type supporting portion being formed as a round plate having a predetermined width on an end part of the radial supporting portion.

9. The inner tub of claim 8, wherein the supporting ribs are protruded as predetermined widths on an inner circumferential surface edge and on the outer circumferential surface edge of the ring type supporting portion.

10. The inner tub of claim 8, wherein a plurality of bolt holes for coupling to the inner tub base using bolts are formed in the circumferential direction of the ring type supporting portion with predetermined gaps therebetween.

11. An inner tub for a washing machine comprising:

an inner tub body in which laundry is received;

an inner tub base formed on a lower part of the inner tub body, the inner tub base comprising a wash water circulating hole, through which the wash water in the inner tub is discharged, formed on a center thereof, and convex portions protruded toward the circumferential direction of the wash water circulating hole formed with predetermined intervals therebetween; and an inner tub hub, to which a rotating shaft of a driving motor is coupled, being below and connected to the convex portions of the inner tub base.

12. The inner tub of claim 11, wherein a bolt coupling hole for coupling with the inner tub hub using bolt is formed on an upper surface of the convex portion of the inner tub base.

13. The inner tub of claim 12, wherein grooves are formed on edge of the inner tub base in the circumferential direction with a predetermined gaps therebetween.

14. An inner tub for a washing machine comprising:

an inner tub body in which laundries are received;

an inner tub base formed on a lower part of the inner tub body and including a wash water circulating hole through which the wash water in the inner tub is circulated formed on a center thereof, and convex portions protruded as a predetermined widths in the circumferential direction of the wash water circulating hole; and an inner tub hub coupled on lower part of the inner tub base, and including a rotating shaft coupling portion to which the rotating shaft is coupled formed on a center thereof, a radial supporting portion extended toward the outer circumferential direction of the rotating shaft coupling portion with a predetermined interval, and a ring type supporting portion having a predetermined width toward the outer circumferential direction of the radial supporting portion.

15. The inner tub of claim 14, wherein the rotating shaft coupling portion includes a rotating shaft coupling hole, to which the rotating shaft for transmitting the rotating force of the driving motor to the inner tub is coupled, penetrated on a center thereof, a plurality of circular ribs formed with a predetermined interval therebetween from the rotating shaft coupling hole to outer side, and a plurality of linear ribs formed in a radial direction centering around the rotating shaft coupling hole.

16. The inner tub of claim 15, wherein a plurality of drainage holes communicated to the drainage opening of the inner tub base to discharge the wash water therethrough are formed between the circular rib of the rotating shaft coupling portion on the inner tub and an adjacent circular rib.

17. The inner tub of claim 14, wherein the radial supporting portion of the inner tub is formed as a plate formed between the outer circumferential surface of the rotating shaft coupling portion and the ring type supporting portion in the circumferential direction with a predetermined interval, and a supporting rib is protruded on an upper surface of the radial supporting portion.

18. The inner tub of claim 17, wherein parts of the radial supporting portion of the inner tub, which are connected to the rotating shaft coupling portion and the ring type supporting portion, are shaped as curved surfaces in order to prevent stress from concentrating on that parts.

19. The inner tub of claim 17, wherein 6 radial supporting portions are formed between the rotating shaft coupling portion and the ring type supporting portion.

20. The inner tub of claim 14, wherein the ring type supporting portion of the inner tub is formed as a round plate having a predetermined width on an end part of the radial supporting portion, and a plurality of bolt holes for coupling to the inner tub base using bolts are formed in the circumferential direction of the ring type supporting portion with predetermined gaps therebetween.

21. The inner tub of claim 20, wherein the supporting ribs are protruded as predetermined widths on an inner circumferential surface edge and on the outer circumferential surface edge of the ring type supporting portion.

22. The inner tub of claim 14, wherein the inner tub hub of the inner tub is formed as a round plate on which a rotating shaft coupling hole is formed, the inner tub hub includes a plurality of supporting ribs having a predetermined shapes protruded on the inner tub hub, and includes a plurality of bolt coupling holes for coupling to the inner tub base using bolts formed in the outer circumferential direction of the inner tub hub.

23. The inner tub of claim 14, wherein a bolt coupling hole is formed on an upper surface of the convex portion of the inner tub base to be coupled to the inner tub hub using a bolt.

24. The inner tub of claim 23, wherein grooves are formed on an edge of the inner tub base in the circumferential direction with predetermined gaps therebetween.

* * * * *